US007431890B2

(12) United States Patent
Kitazawa

(10) Patent No.: US 7,431,890 B2
(45) Date of Patent: Oct. 7, 2008

(54) FLUID SYSTEM COUPLER

(75) Inventor: Mutsuya Kitazawa, Nagano (JP)

(73) Assignee: Sakura Finetek U.S.A., Inc., Torrance, CA (US)

( * ) Notice: Subject to any disclaimer, the term of this patent is extended or adjusted under 35 U.S.C. 154(b) by 96 days.

(21) Appl. No.: 10/715,574

(22) Filed: Nov. 17, 2003

(65) Prior Publication Data

US 2005/0106075 A1 May 19, 2005

(51) Int. Cl.
*B01L 3/00* (2006.01)

(52) U.S. Cl. ..... 422/102; 222/181.1; 222/185.1; 222/484; 422/63; 422/64; 422/65; 422/99; 422/101; 422/103; 422/100

(58) Field of Classification Search ..... 422/99–103, 422/63–65; 436/54; 215/43; 222/484, 181, 222/185
See application file for complete search history.

(56) References Cited

U.S. PATENT DOCUMENTS 4,806,316 A * 2/1989 Johnson et al. ..... 422/100
4,854,486 A * 8/1989 Daley et al. ..... 222/484
5,366,902 A * 11/1994 Cox et al. ..... 436/165
5,573,046 A * 11/1996 Venooker et al. ..... 141/285
5,578,494 A * 11/1996 Clark et al. ..... 436/54

OTHER PUBLICATIONS

International Preliminary Examination Report for PCT Application No. PCT/US04/37071 filed Nov. 4, 2004.

* cited by examiner

*Primary Examiner*—Jill Warden
*Assistant Examiner*—Jyoti Nagpaul
(74) *Attorney, Agent, or Firm*—Blakely, Sokoloff, Taylor & Zafman, LLP

(57) ABSTRACT

A tissue processing system includes a tissue processor for processing tissue using reagent fluids, a fluid container and a coupler providing bi-direction fluid communication between the tissue processor and the fluid container. The coupler includes first and second cylindrical rings separated by a wall and a fluid conduit disposed within the first and second cylindrical rings that pass through the wall, thereby providing fluid communication from the fluid container to the tissue processor. Fluid is returned from the tissue processor to the fluid container via at least one fluid return aperture in the wall that separates the first and second cylindrical rings.

27 Claims, 4 Drawing Sheets

FLUID SYSTEM COUPLER

FIELD OF THE INVENTION

The present invention is directed to a coupler providing fluid communication between a container and a tubing system, as may be used in instruments requiring reagent or fluid supply.

BACKGROUND OF THE INVENTION

Tissue processors can be operated with varying levels of automation to process tissue for histology or pathology, such as from tissue grossing through slide staining. Various types of fluids, including chemical reagents, can be used at various stages of tissue processing. The fluids can be furnished in various ways, such as via small quantity release dispensers, manual dispensing into reagent vats, or via bulk containers connected with a processor via tubing.

There are various disadvantages of these prior systems. For example, manually pouring into (or draining) reagent vats suffers a disadvantage being time consuming and requiring pouring accuracy, decreasing the overall efficiency of the tissue processing system. Another disadvantage is that manual operations can be sloppy, requiring clean up of spills and consequential instrument down time. A further disadvantage is that care is required in selecting the correct reagent, increasing the possibility that reagents may be poured into the incorrect vat, either decreasing test accuracy or decreasing operational efficiency as the mistake is corrected.

As another example, one known system provides a reagent container connected via a tube protruding through a cap. This can suffer disadvantages of leakage in processing and difficulty in properly connecting the tubes.

In addition the known systems can engender risks that incorrect fluids are used, leading to inaccuracies or other damage in a processing operation. Various connector arrangements also are known, but may suffer disadvantages or connectability to various instruments other than the desired instruments.

Accordingly, there exists a need for a structured coupler that provides a fluid connection between one or more fluid containers and a tissue processor.

SUMMARY OF THE INVENTION

The present invention alleviates to a great extent the disadvantages of the known devices for providing fluids such as reagents to processing systems requiring the fluids. The preferred example provided is of couplers providing a fluid connection between a fluid container and a tissue processing system, such as may be used in pathology or histology laboratory for processing harvested tissue samples for ultimate examination or testing. A coupler is provided that connects to a fluid container and to one or more mating component of the processing system. Preferably, the coupler provides bi-directional fluid communication between at least one fluid container and a receiving tubing system of an instrument.

In one embodiment of the invention, the coupler has a structure for connecting with a fluid container, such as internal threads or a pin connector. Preferably the inside of the connector forms a fluid tight seal with the container. The coupler also includes a structure for connecting to a mating connector in the tissue processor, and the coupler preferably also provides for bi-directional fluid communication between the fluid container and the tissue processor. The structure optionally includes concentric cylinders, which also will be referred to as cylindrical rings, providing at least one egress opening surrounded by a cylindrical ring through which fluid can flow from the container to the tissue processor. Also provided is at least one input opening through which fluid can flow from the tissue container to the tissue processor. The input opening or openings preferably are located concentrically outwards from the cylindrical ring around the egress opening. A further cylindrical ring is provided concentrically outward from the input opening(s), forming a portion of a ring seal with corresponding structure on the connector in the tissue processor.

In one embodiment, the coupler is used for connecting a reagent container to a tissue processing system. However, it should be understood that the coupler can be used for connecting any suitable fluid container to a fluid using system. In the fluid using system, a mating connector is provided to link with the coupler. Preferably, the mating connector has cylindrical rings that mate with corresponding cylindrical rings on the coupler, forming fluid tight seals, both with the exterior and between the egress and input openings. In addition, the connector can provide a connection to tubing directing the fluid as desired within the fluid using system from the egress opening of the coupler. The fluid using system also preferably includes a locking assembly for attaching the coupler in fluid communication with the connector. In one embodiment, the locking assembly includes a handle that can be manually engaged to displace the connector to a position in which its cylindrical rings extend within the coupler's rings. Optionally, the locking assembly and coupler are color coordinated to assist an operator to position correct reagent containers in the correct location on the fluid using system.

In one application, the fluid container is used to provide microwave retort reagents to a tissue processing system. Once tissue processing using the reagents has been completed, the reagents may be drained back into the fluid container. The fluid container is optionally designed for one time use only.

These and other features and advantages of the present invention will be appreciated from review of the following detailed description of the invention, along with the accompanying figures in which like reference numerals refer to like parts throughout.

DETAILED DESCRIPTION

In the following paragraphs, the present invention will be described in detail by way of example with reference to the figures. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Figure 1:
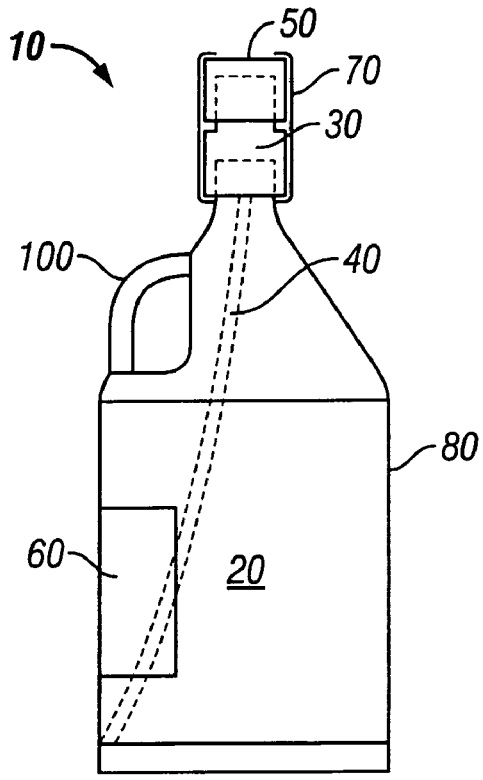
FIG. 1 is a perspective view of an assembly in accordance with the principles of the present invention.
Figure 2:
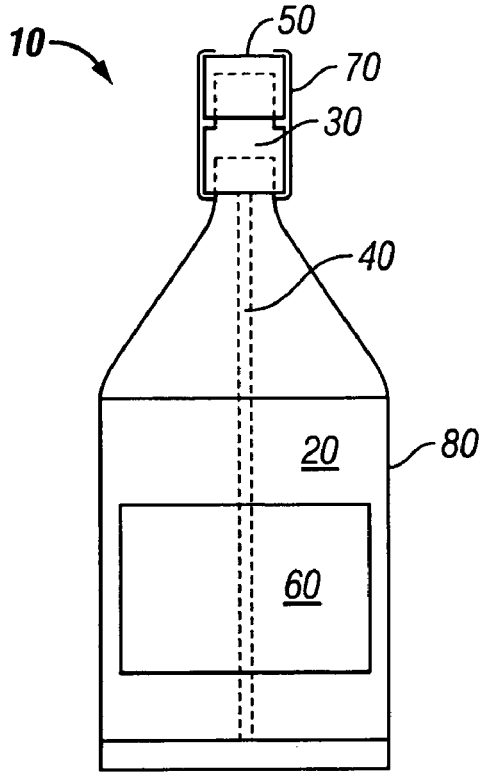
FIG. 2 is a perspective view of an assembly in accordance with the principles of the present invention.

Referring to FIGS. 1 and 2, an embodiment of a fluid container assembly 10 according to present invention will be described. Generally speaking, the fluid container assembly 10 comprises fluid container 20, coupler 30, tube 40 and cap 50. Coupler 30 illustrates an example of a coupler in accordance with the present invention that provides fluid communication between the container 20 and a fluid using system, such as for example a tissue processor 55 (see FIG. 9). Tubing 40 extends from the coupler to the bottom of fluid container 20.

Fluid container 20 optionally includes a label 60. The label 60 can display information concerning the contents of the fluid container 20 and instructions for operation and storage. In one embodiment, the label 60 is, or includes, a machine readable graphic, such as a bar code. The machine readable graphic can contain any form of desired identifying or usage information, such as identification of the type of fluid, size of container, storage recommendations, shelf life, expiration date, instrument identifiers and so on.

The cap 50 is optionally provided to provide a fluid-tight seal over coupler 30. However, other forms of fluid-tight seals, such as foil or coated paper also may be used. The fluid container assembly 10 optionally includes a tamper resistant seal 70 disposed around cap 50. The tamper resistant seal 70 can be any form of seal such as a plastic or shrink wrap that can inhibit accidental opening of cap 50. In the illustrated embodiment, fluid container 20 also includes a body 80, a neck 90 and a handle 100, although any structure of container 20 can be used that can contain a fluid retained within it. In a preferred embodiment, fluid container 20 is preferably made from a durable plastic such as high density polyethylene, but alternatively it can be made of other polymeric materials, glass, lined or coated paper or cellulose etc.

Figure 3:
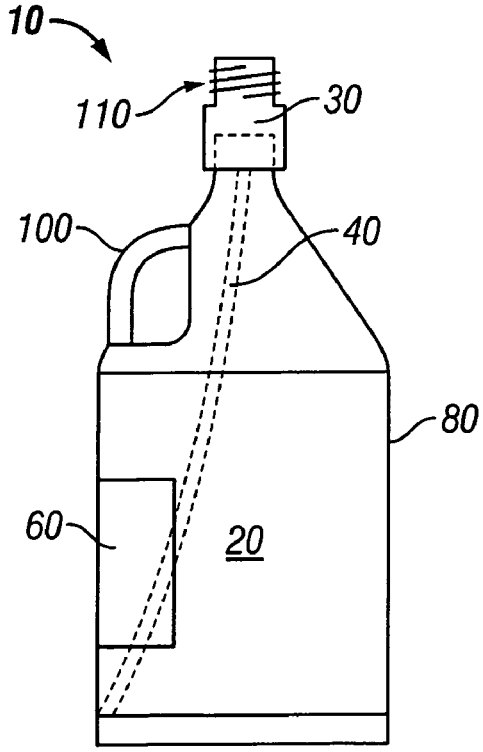
FIG. 3 is a perspective view of an assembly in accordance with the principles of the present invention.
Figure 4:
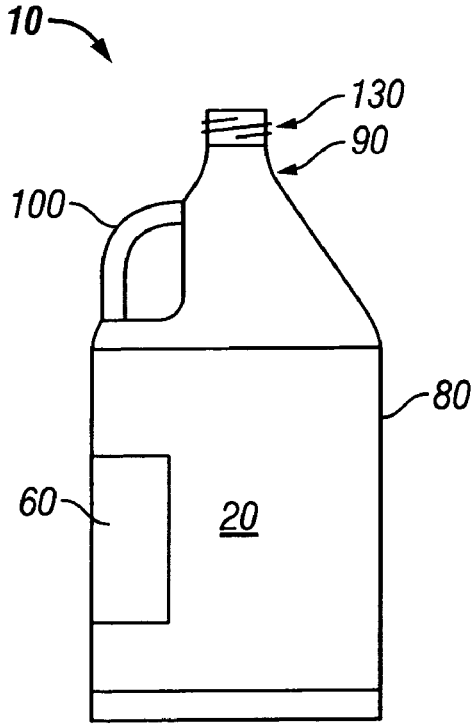
FIG. 4 is a side view of an assembly in accordance with the principles of the present invention.

FIG. 3 shows the fluid container assembly 10 after an optional tamper resistant seal 70 and cap 50 have been removed, and FIG. 4 shows the fluid container assembly 10 without coupler 30 and tubing 40. In the illustrated embodiment, coupler 30 includes external spiral threads 110 that receive corresponding spiral threads disposed on the interior surface of cap 50. Alternatively, cap 50 may be attached to coupler 30 by other means such as by force fit or friction fit.

Figure 5:
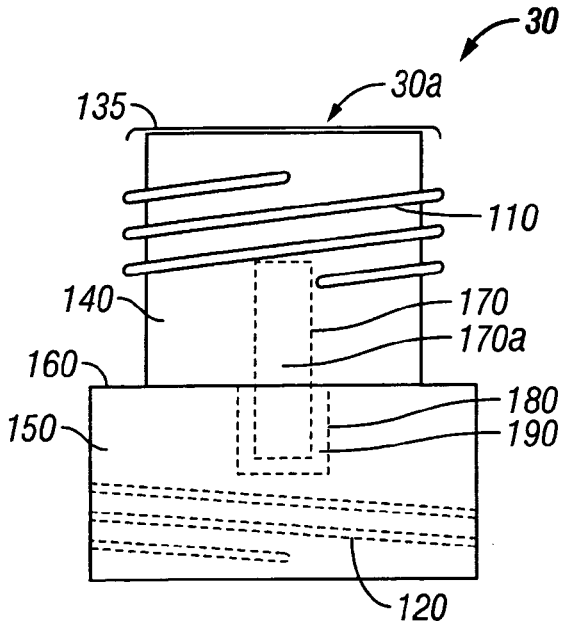
FIG. 5 is a perspective view of a component of an assembly in accordance with the principles of the present invention.
Figure 6:
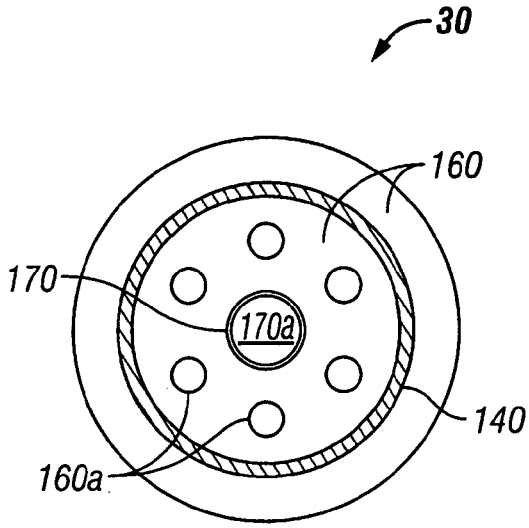
FIG. 6 is a top view of a component of an assembly in accordance with the principles of the present invention.

Referring to FIG. 5, coupler 30 further includes internal spiral threads 120 for engaging complementary spiral threads 130 (see FIG. 4) disposed around the neck of fluid container 20. Coupler 30 may be made from any number of materials including, but not limited to, plastics, glass and other materials. By way of example, one suitable material for coupler 30 is polypropylene. Coupler 30 optionally includes a seal 135 that covers a top end 30*a* of the coupler during shipping. Seal 135 preferably comprises a thin sheet of aluminum foil having one side covered with adhesive. The seal should be peeled off of the coupler prior to use.

Referring to FIGS. 5-8, coupler 30 comprises first and second cylindrical rings 140, 150 interconnected by a wall 160 including at least one ventilation aperture 160*a*. As best seen in FIG. 5, first cylindrical ring 140 includes external spiral threads 110 for engaging cap 50 and second cylindrical ring 150 includes internal spiral threads 120 for engaging fluid container 20. Coupler 30 further comprises an inner cylindrical ring 170 that forms a fluid conduit 170*a* extending through wall 160 from the first cylindrical ring into the second cylindrical ring. Fluid conduit 170 permits fluids (such as reagents) to be drawn upwardly from tubing 40 and into the tissue processor 55. In the illustrated embodiment, wall 160 includes six ventilation apertures 160*a* concentrically spaced about fluid conduit 170. As would be understood to those of skill in the art, any number, shape and arrangement of apertures my be used to achieve the desired amount of ventilation without departing from the scope of the present invention.

Figure 8:
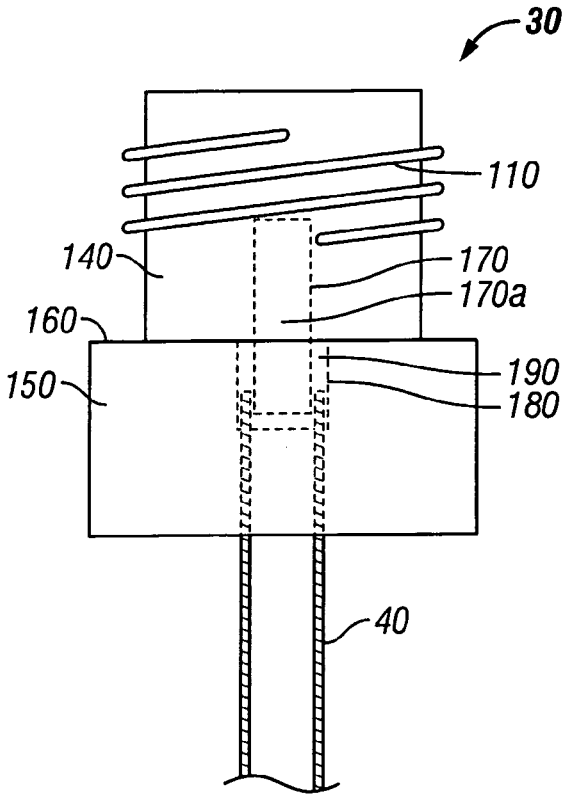
FIG. 8 is a sectional view of a component of an assembly in accordance with the principles of the present invention.
Figure 7:
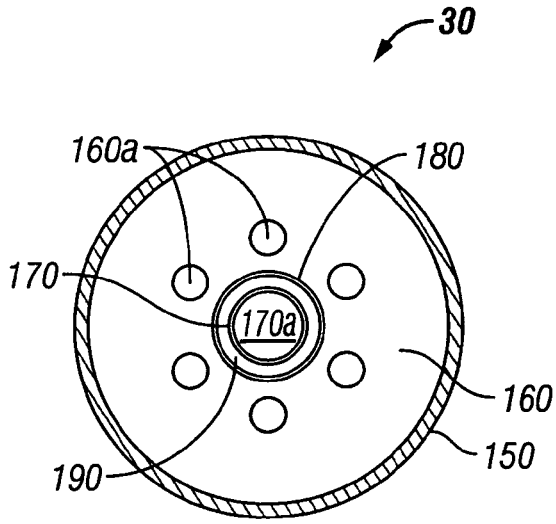
FIG. 7 is a bottom view of a component of an assembly in accordance with the principles of the present invention.

Coupler 30 further comprises a retention cylindrical ring 180 for maintaining fluid communication between fluid conduit 170 and tubing 40. More particularly, as shown in FIG. 8, retention cylindrical ring 180 extends downwardly from wall 160 around the outer circumference of fluid conduit 170, thereby forming a cylindrical gap 190 between the fluid conduit and retention cylindrical ring. In FIG. 8, the dotted lines representing internal spiral threads 120 have been removed for illustrative purposes. As shown in FIG. 8, tubing 40 is dimensioned to be attached to coupler 30 by way of a force or friction fit within cylindrical gap 190. Alternatively, the coupler and tubing may be welded together, or otherwise manufactured as a single integral piece.

Figure 9:
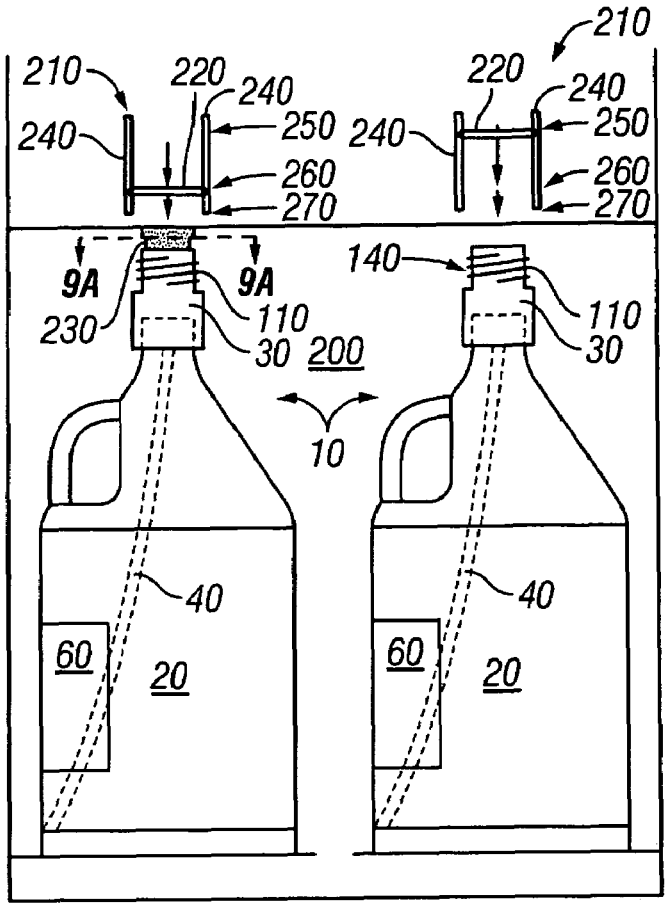
FIG. 9 is a perspective view of an assembly in accordance with the principles of the present invention.

Referring to FIG. 9, a pair of container assemblies 10 are disposed within a cabinet 200 of tissue processor 55. Each fluid container assembly 10 can be connected in fluid communication with the tissue processor using a locking assembly 210. Locking assembly 210 comprises a handle 220 for displacing a fluid connector 230. More particularly, in order to lock down a fluid container 20, handle 220 is displaced downward within slots 240 from an unlocked position 250 to a locked position 260 such that fluid connector 230 moves from an unlocked first position above coupler 30 to a locked second position within the top cylindrical ring 140 of coupler 30. To release the locking assembly, handle 220 is further displaced downward within slots 240 to a release position 270, thereby causing fluid connector 230 to retract to the unlocked position above coupler 30.

According to some embodiments, the locking assemblies 210 and container assemblies 10 are color coordinated to facilitate proper matching. As an example, a fluid container assembly 210 may include a yellow coupler 30 adapted to match a locking assembly 210 including a yellow handle 220. Likewise, a fluid container assembly 210 may include a purple coupler 30 adapted to match a locking assembly 210 including a purple handle 220. Alternatively, other components of the locking and container assemblies (e.g., the fluid connector 230 and label area 60) may be color coordinated to facilitate proper fluid container positioning.

Figure 10:
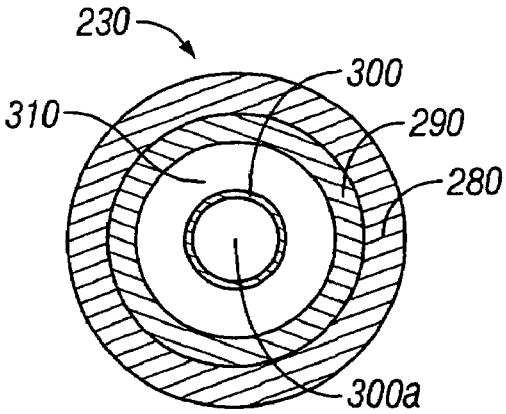
FIG. 10 is a cross-sectional view of the assembly of FIG. 9 taken along line 9A-9A.
Figure 11:
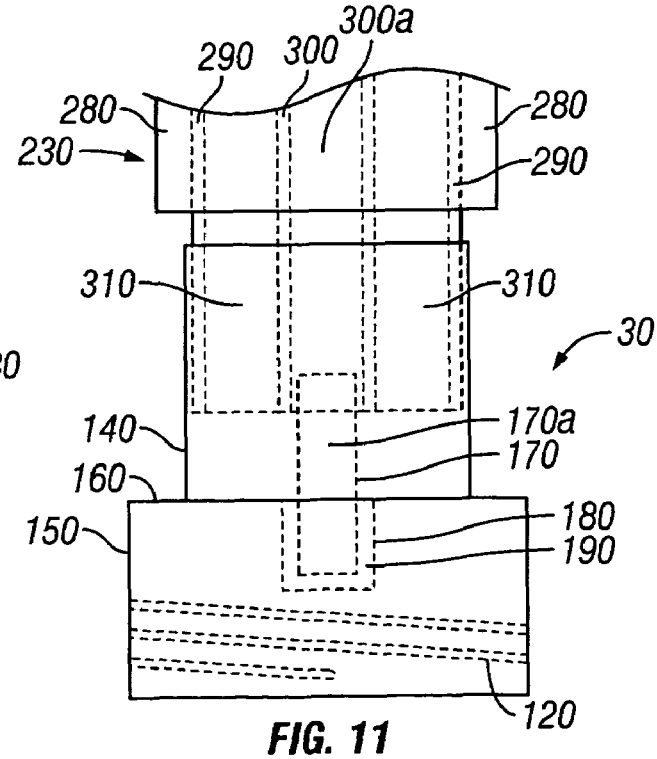
FIG. 11 is a perspective view of an assembly in accordance with the principles of the present invention.

Referring to FIGS. 10 and 11, fluid connector 230 comprises a two-way fluid valve including three concentric rings 280, 290, 300 comprising an outer ring 280, a middle ring 290 and an inner ring 300 forming a central fluid conduit 300*a*. In addition, there exists a cylindrical space between middle ring 290 and inner ring 280, which forms a ventilation conduit 310. FIG. 11 shows the fluid connector in the locked position within the top cylindrical ring 140 of coupler 30. Rings 290, 300 are adapted to slide telescopically within outer ring 280 such that rings 290, 300 are displaced downward when handle 220 is pulled downward from the unlocked position 250 to the locked position 260. In the locked position, a portion of inner cylindrical ring 170 is disposed within inner ring 300, thereby providing fluid communication from fluid conduit 170*a* to fluid conduit 300*a*. Additionally, a portion of middle ring 290 is disposed within the upper cylindrical ring 140 of coupler 30, thereby providing communication from ventilation conduit 310 to fluid container 20 via ventilation apertures 160*a*. To ensure fluid tight connections, one or more o-rings may be provided between inner cylindrical ring 170 and inner ring 300 and between middle ring 290 and upper cylindrical ring 140.

Figure 12:
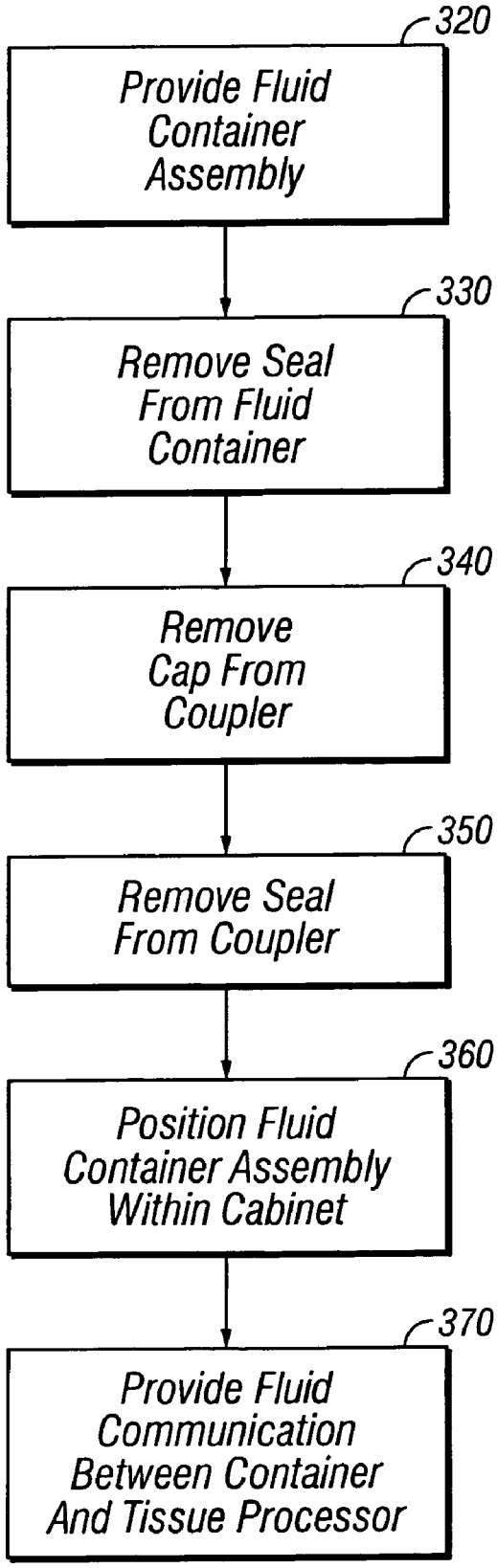

Referring to FIG. 12, a method of coupling a fluid container assembly 10 with a tissue processor 55 having one or more fluid container locking assemblies 210 will now be described. As illustrated diagrammatically as box 320, the initial step involves providing a fluid container assembly including a fluid container having a neck, a coupler attached to the neck and a cap attached to the coupler. As illustrated diagrammatically as box 330, the next step involves removing an optional seal 70 from fluid container 20. This step may be accomplished by peeling off the seal or cutting it off(e.g., with a pair of scissors).

As illustrated diagrammatically as box 340, the next step involves removing cap 50 from coupler 30. According to some embodiments, the cap is removed by twisting in a counterclockwise direction. According to other embodiments, cap 50 is attached by way of force fit and must be pulled off of coupler 30 using a predetermined amount of force. As illustrated diagrammatically as box 350, the next step involves removing an optional seal 135 from the top end 30*a* of coupler 30. This step may be accomplished by peeling off the seal or cutting it off (e.g., with a pair of scissors).

As illustrated diagrammatically as box 360, the next step involves properly positioning fluid container assembly 20 within the cabinet 200 of tissue processor 55, as depicted in FIG. 9. This step involves determining the type of fluid within the container and positioning the fluid container assembly adjacent an appropriate locking assembly 210. If fluid container assembly 20 and locking assembly 210 are color coordinated, then the step involves matching the colors of the container and locking assemblies. As illustrated diagrammatically as box 370, the next step involves mating the container and locking assemblies, thereby providing fluid communication between container 20 and tissue processor 55. Referring to FIG. 11, this step involves displacing a portion of the locking assembly relative to coupler 30. More particularly, this step involves pulling handle 220 downward such that the inner and middle rings are moved partially within the coupler, thereby providing communication between fluid conduits 170*a*, 300*a* and between ventilation conduit 310 and ventilation apertures 160*a*

After proper attachment has been made between fluid container assembly 20 and machine 55, tissue processing can begin. In operation, fluid is drawn into the tissue processor from container 10 through tubing 40, fluid conduit 170*a* and fluid conduit 300. After tissue processing using the fluid has been completed, the fluid is automatically returned to the container through fluid conduit 300, fluid conduit 170*a* and tubing 40. After fluid return, cap 50 is mated with coupler 30 and fluid container assembly 20 is disposed in a conventional manner.

Thus, it is seen that a coupler providing bi-directional fluid communication between a fluid container and a tissue processor is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. A coupler connecting a fluid reservoir and a processing apparatus comprising:

a first longitudinally extending cylindrical ring defining an interior area;

a second cylindrical ring longitudinally adjacent the first cylindrical ring; and a longitudinally extending fluid conduit positioned within the interior area of the first cylindrical ring and through a laterally extending wall into the second cylindrical ring, the fluid conduit defining a fluid flow aperture, wherein the laterally extending wall is positioned between the first cylindrical ring and the second cylindrical ring, the laterally extending wall having a top surface directed towards the processing apparatus and defining at least one vent aperture creating fluid venting communication between the fluid reservoir and the top surface.

2. The coupler of claim 1 wherein the at least one vent apertures provide fluid venting communication between the reservoir and the processing apparatus.

3. The coupler of claim 1 wherein the fluid conduit provides bi-directional fluid communication between the fluid reservoir and the processing apparatus.

4. The coupler of claim 1, wherein the first and second cylindrical rings have substantially the same diameter.

5. The coupler of claim 1, wherein the first cylindrical ring has a first diameter and the second cylindrical ring has a second diameter.

6. The coupler of claim 1 wherein the fluid conduit extends through the wall and extends within an interior space defined by the second cylindrical ring.

7. The coupler of claim 1 further comprising a retention cylindrical ring disposed within the second cylindrical ring.

8. The coupler of claim 7 wherein the retention cylindrical ring is disposed around the fluid conduit forming a cylindrical gap between the fluid conduit and retention cylindrical ring.

9. The coupler of claim 1, further comprising a plurality of vent apertures arranged concentrically within the wall.

10. The coupler of claim 1, wherein the first cylindrical ring is configured to mate with a corresponding connector on the processing apparatus substantially forming a seal creating an enclosure between the interior of the first ring and the processing apparatus.

11. The coupler of claim 1 wherein the fluid conduit is configured to mate with a corresponding fluid conduit of the processing apparatus.

12. The coupler of claim 1, including a concentric vent ring formed by an outer surface of the fluid conduit and inner surface of the first concentric ring.

13. The coupler of claim 12 wherein the concentric vent ring is in communication with the interior of the tissue processor.

14. The coupler of claim 1, wherein the fluid conduit is disposed within the first and second cylindrical rings and passes through the wall between interior spaces defined by the rings.

15. An apparatus providing fluid communication between a fluid container and a processor comprising:

a first longitudinally extending cylindrical ring;

a second longitudinally extending cylindrical ring;

a longitudinally extending fluid conduit within the first cylindrical ring and the second cylindrical ring, wherein the fluid conduit provides bi-directional fluid communication between the fluid container and the processor; and a laterally extending barrier between the first cylindrical ring and the second cylindrical ring, the barrier having first and second sides.

16. The apparatus of claim 15, further comprising at least one vent aperture provided in the barrier, the vent aperture creating fluid venting communication between the first side of the barrier and the second side of the barrier within an area defined by the first cylindrical ring.

17. The device of claim 16, wherein the vent aperture provides ventilation between the fluid container and the processor.

18. A coupler connecting a fluid reservoir and a processing apparatus comprising:

a first longitudinally extending cylindrical ring defining an interior area;

a longitudinally extending liquid conduit positioned within the interior area and defining a liquid flow aperture; and a laterally extending wall adjacent the first cylindrical ring and the liquid conduit, the laterally extending wall having a top surface directed towards the processing apparatus and defining at least one vent aperture creating fluid venting communication between the fluid reservoir and the top surface, wherein the liquid conduit extends through the wall and extends beyond the top surface of the wall within the interior space defined by the first cylindrical ring.

19. The coupler of claim 18 wherein the at least one vent apertures provide fluid venting communication between the reservoir and the processing apparatus.

20. The coupler of claim 18 wherein the liquid conduit provides bi-directional liquid communication between the fluid reservoir and the processing apparatus.

21. The coupler of claim 18, further comprising a second cylindrical ring longitudinally adjacent the first cylindrical ring.

22. The coupler of claim 21 wherein the liquid conduit extends through the wall and extends within an interior space defined by the second cylindrical ring.

23. The coupler of claim 18, further comprising a plurality of vent apertures arranged concentrically within the wall.

24. The coupler of claim 18, wherein the first cylindrical ring is configured to mate with a corresponding connector on the processing apparatus substantially forming a seal creating an enclosure between the interior of the first ring and the processing apparatus.

25. The coupler of claim 18 wherein the liquid conduit is configured to mate a with a corresponding fluid conduit of the processing apparatus.

26. The coupled of claim 18, including a concentric vent ring formed by an outer surface of the liquid conduit and an inner surface of the first concentric ring.

27. The coupler of claim 18, wherein the liquid conduit is disposed within the first and second cylindrical rings and passes through the wall between interior spaces defined by the rings.

* * * * *